US006263711B1

(12) United States Patent
Kuo

(10) Patent No.: US 6,263,711 B1
(45) Date of Patent: Jul. 24, 2001

(54) CABLE LOCK

(76) Inventor: Fu-Sheng Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/527,724

(22) Filed: Mar. 17, 2000

(51) Int. Cl.[7] ..... E05B 73/00
(52) U.S. Cl. ..... 70/18; 70/49; 70/233
(58) Field of Search ..... 70/18, 30, 49, 70/233

(56) References Cited

U.S. PATENT DOCUMENTS 3,435,642 * 4/1969 Del Pesco ..... 70/49
4,033,160 * 7/1977 Mima ..... 70/233
4,850,207 * 7/1989 Ylven ..... 70/49
5,197,310 * 3/1993 Pedersen ..... 70/49 X
5,568,740 * 10/1996 Lin ..... 70/49
5,829,280 * 11/1998 Chen ..... 70/49
5,896,762 * 4/1999 Iidaka et al. ..... 70/49 X
5,916,283 * 6/1999 Steinbach ..... 70/49 X

* cited by examiner

*Primary Examiner*—Suzanne Dino Barrett
(74) *Attorney, Agent, or Firm*—Alan Kamrath; Rider, Bennett, Egan & Arundel, LLP

(57) ABSTRACT

A cable lock has a cable and a latch assembly. The latch assembly includes a body, a latch bolt, a lock post and a cylinder. One end of the cable is permanently connected to the body. A latch bolt can be detachably inserted into the body and is permanently connected to the other end of the cable. A lock post is rotatably mounted in the body to securely lock the lock post. The cylinder has a keyhole defined in one end of the cylinder, a spindle rotatably mounted on the other end of the cylinder and means for activating the lock post to rotate with the spindle to release the latch bolt. This configuration provides enough space to allow the cable to curl. A force unbalance can be avoided, and the ease of locking or unlocking the cable lock will be improved.

12 Claims, 5 Drawing Sheets

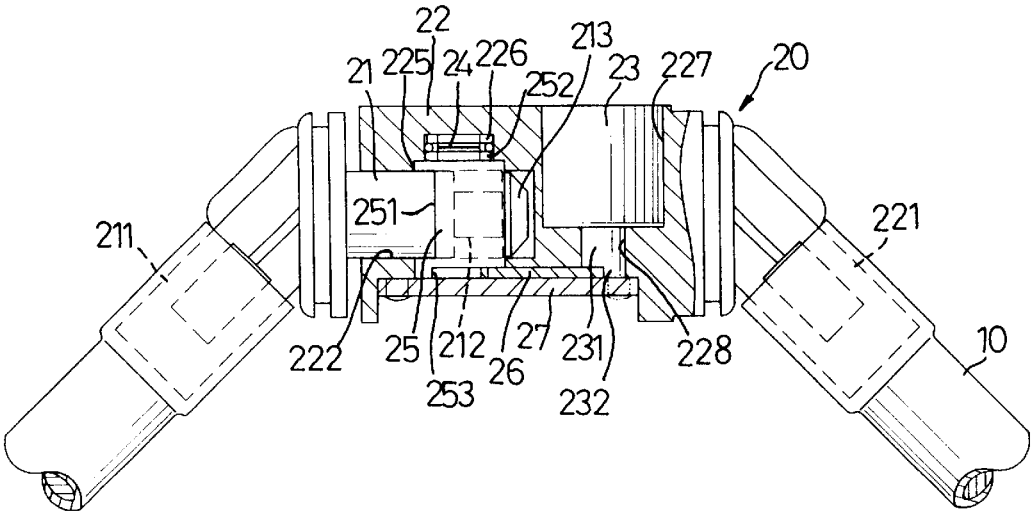
FIG.3
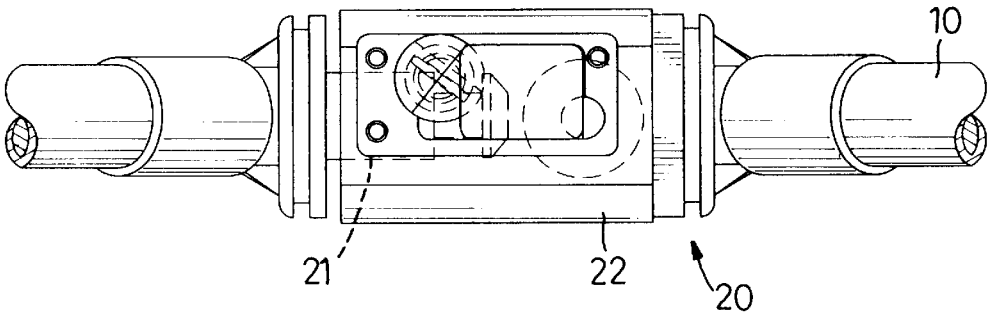
FIG.4
FIG.5
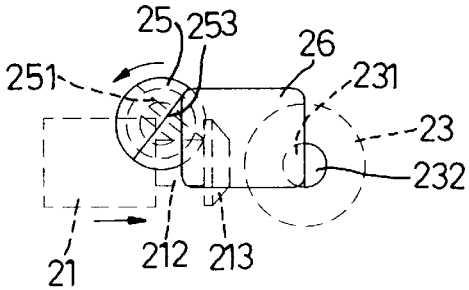

CABLE LOCK

BACKGROUND OF THE INVENTION

1. Field of the Invention

The present invention relates to a cable lock, and more particularly to a cable lock for a bicycle.

2. Description of Related Art

Referring to FIG. 7, a conventional cable lock in accordance with the prior art comprises a steel cable (40) and a latch assembly (50). One end of the cable (40) is securely connected to one end of the latch assembly (50). A latch bolt (42) is axially attached to the other end of the cable (40) and can be detachably inserted into a locking hole (52) defined in the periphery of the latch assembly (50). A lock unit is mounted in the latch assembly (50) to securely hold the latch bolt (42) in the locking hole (52). With such an arrangement, the cable (40) can circle around a tree, a post or the like to keep the bicycle with the cable lock appropriately mounted from being stolen . In addition, a keyhole is defined in the latch assembly (50). When the corresponding key is inserted into the keyhole and turned to unlock the lock unit, the latch bolt (42) will be released from the locking hole (52).

Generally, when the cable lock is not extended and locked around an object, the cable (40) will curl into a plurality of circles due to the flexibility and resiliency of the cable (40). However, when the cable (40) is extended around an object and locked into the latch assembly (50), the cable (40) will form a single loop because there is not enough slack in the cable (40) for it to curl into the smaller loops. However, the resiliency of the cable exerts a restoring force on the cable (40), which increases the difficulty of locking or unlocking the cable lock.

To overcome the shortcomings, the present invention tends to provide an improved cable lock to mitigate or obviate the aforementioned problems.

SUMMARY OF THE INVENTION

The main objective of the invention is to provide an improved cable lock having a cable and a latch assembly. The latch assembly includes a body, a latch bolt, a lock post and a cylinder. One end of the cable is permanently fixed to the body. A latch bolt axially connected to the free end of the cable can be detachably inserted into the body. The lock post is rotatably mounted in the body to securely lock the latch bolt. The cylinder has a keyhole defined in one end of the cylinder, a spindle rotatably mounted on the other end of the cylinder and means for rotating the lock post relative to the spindle to release the latch bolt. With such an arrangement, there is an enough space to allow the unused portion of the cable to curl. This avoids the necessity of completely extending the cable to ease locking or unlocking of the cable lock.

Other objects, advantages and novel features of the invention will become more apparent from the following detailed description when taken in conjunction with the accompanying drawings.

BRIEF DESCRIPTION OF THE DRAWINGS

FIG. 3 is a plan view in partial section of the latch assembly in FIG. 1;

FIG. 4 is an inside plan view of the latch assembly in FIG. 1;

FIG. 5 is an operational plan view of the latch assembly in FIG. 1 showing the latch bolt inserted into the body and rotating the lock post relative to the body;

DETAILED DESCRIPTION OF PREFERRED EMBODIMENT

Figure 1:
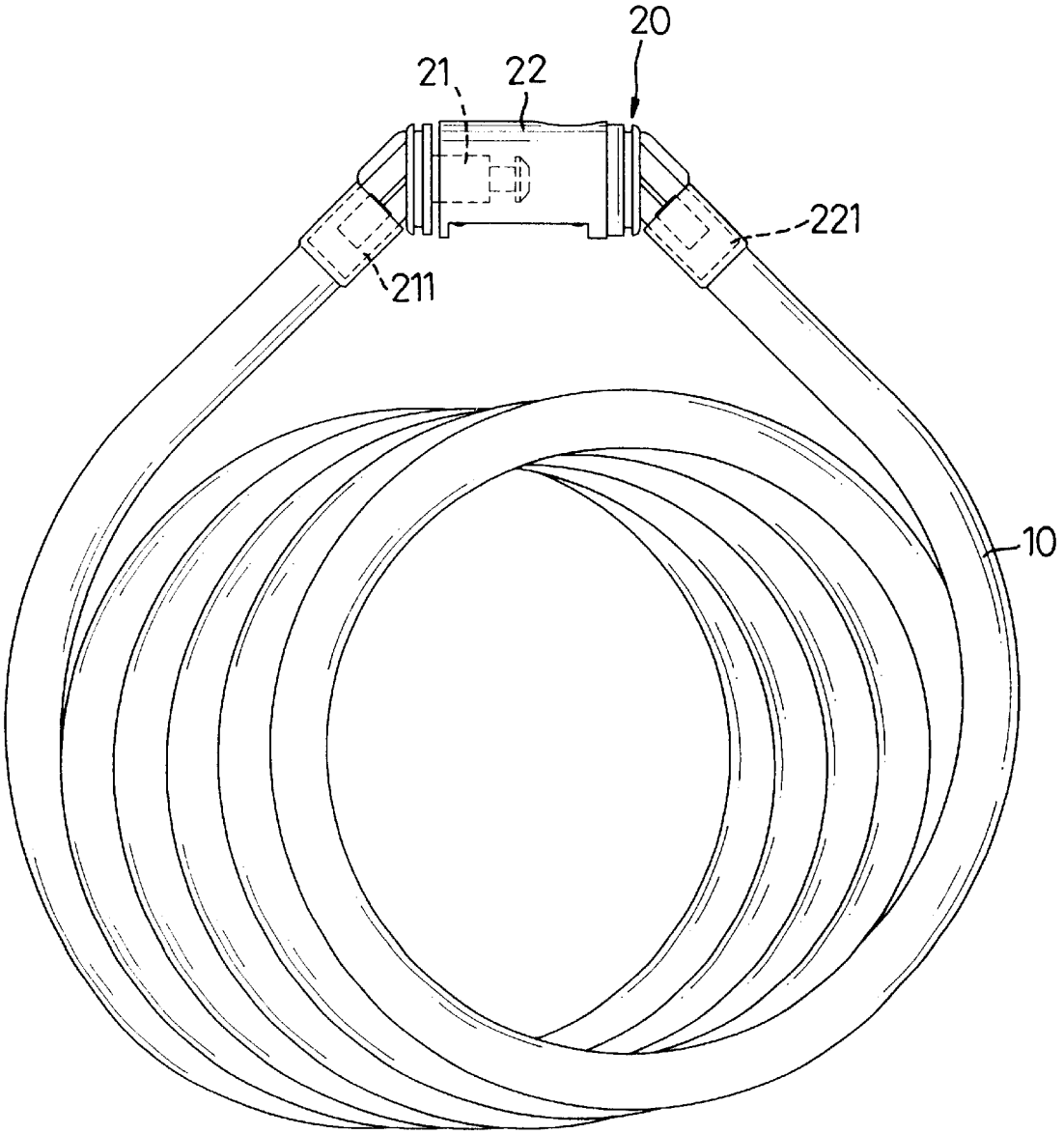
FIG. 1 is a top plan view of a cable lock in accordance with the present invention.
Figure 2:
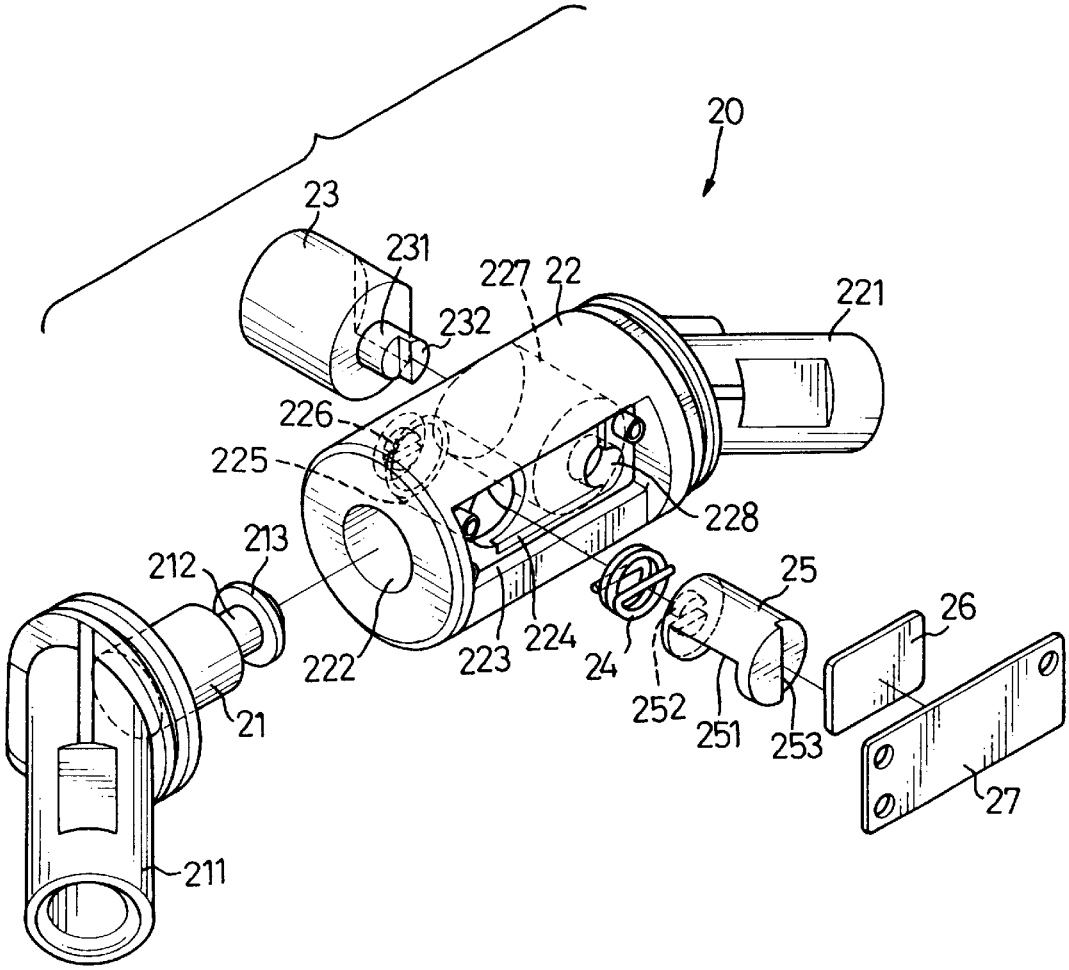
FIG. 2 is an exploded perspective view of the latch assembly of the cable lock in FIG. 1.

Referring to FIGS. 1–3, a cable lock in accordance with the present invention comprises a steel cable (10) and a latch assembly (20). The latch assembly (20) includes a body (22) with one end of the cable (10) permanently attached to the body (22). A latch bolt (21) is permanently connected to the other end of the cable (10). Preferably, a connecting tube (211,221) is formed on one end of the latch bolt (21) and the body (22) to fixedly connect with the corresponding end of the cable (10). A central hole (222) is defined in the other end of the body (22) away from the connecting tube (221) attached to the body (22). The latch bolt (21) is detachably inserted into the central hole (222). An integrally formed neck (212) with a diameter smaller than the latch bolt (21) extends from the free end of the latch bolt (21). A flanged head (213) is formed on the end of the neck (212).

A recess (223) is defined in the outer periphery of the body (22). A hole (225) is defined in the face of the recess (223) and communicates with the central hole (222). A lock post (25) is rotatably received in the hole (225) and has a recess (251) defined in the outer periphery of the lock post (25), such that a lock portion is formed on the post (25). When the latch bolt (21) is inserted into the central hole (222), the lock portion of the lock post (25) will abut the neck (212) of the latch bolt (21) to securely hold the latch bolt (21) in the body (22). In addition, a semicircular block (253) co-axially protrudes from one end of the post (25) and extends into the recess (223). A twisting spring (24) is co-axially mounted on the lock post (24) to provide a twisting force to the post (25). A pair of protrusions (226) integrally extends from the face of the hole (225) and another pair of protrusions (252) extends from the end of the lock post (25) to hold the ends of the twisting spring (24).

A chamber (227) is defined in the body (22) to receive a cylinder (23). The cylinder (23) has a lock unit mounted therein, a keyhole defined in one end and a spindle (231) extending out from the other end. A semicircular block (232) co-axially extends from the free end of the spindle (231). A through hole (228) is defined in the face of the chamber (227) and communicates with the recess (223) of the body (22) so the spindle (231) can extend into the recess (223).

A plate (26) is slidably mounted in the body (22) recess (223) and has two ends abutting the flat faces of the semicircular blocks (232, 253) of the spindle (23) and lock post (25) respectively. Preferably, a track (224) is defined in the face of the recess (223) to slidably receive the plate (26). In addition, a cover (27) is securely mounted on the body (22) to hold the plate (26) in the recess (223).

With reference to FIGS. 2–5, when the user inserts the latch bolt (21) into the central hole (222), the head (213) will push the lock portion of the lock post (25), and the lock post (25) will rotate relative to the body (22). So that, the recess (251) of the lock post (25) will rotate parallel to the longitudinal axis of the body (22) and allows the head (213)

to pass through. When the head (213) passes through the lock post (25), the twisting force of the spring (24) will rotate the lock post (25) and the lock portion of the post (25) will abut the neck (212) and the inside of the flanged head (213). This limits the outward movement of the latch bolt (21) to securely hold the latch bolt (21) in the central hole (222). Thus, the cable lock will automatically lock as the user inserts the latch bolt (21) into the central hole (222). Consequently, the cable (10) can be securely looped, as shown in FIG. 1, and circle around a post, a tree or the like to keep a bicycle from being stolen. Furthermore, because the two ends of the cable (10) are connected to two ends of the body (22) respectively, therefore there is enough space to allow the cable (10) to curl when the cable lock is locked.

Figure 6:
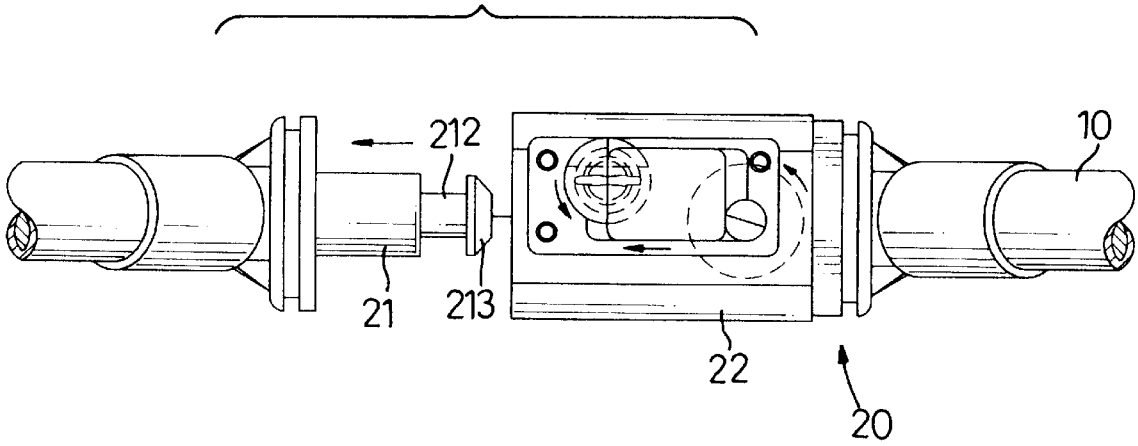
FIG. 6 is an operational inside view of the latch assembly in FIG. 1 showing the latch bolt being unlocked by the action between the cylinder, the plate and the lock post.
Figure 7:
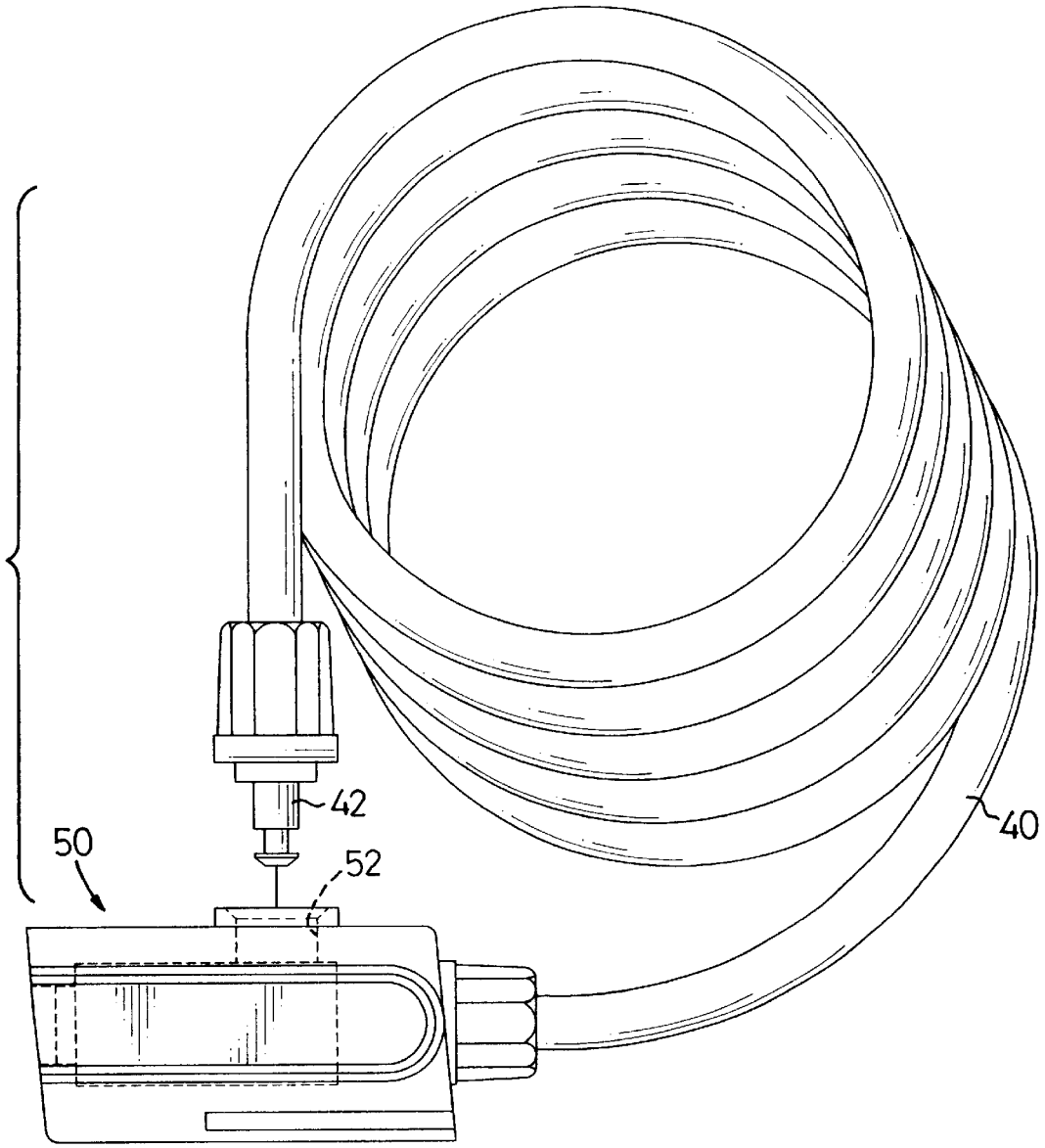
FIG.7 PRIOR ART
FIG. 7 is a top plan view of a conventional cable lock in accordance with the prior art.

Referring to FIGS. 2 and 6, when the user want to unlock the cable lock, he or she must insert a matching key into the keyhole of the cylinder (23) and turn the key, which rotates the spindle (231). The block (232) of the spindle (231) will push the plate (26) along the track (224), which pushes the lock post (25) that rotates relative to the body (22). When the recess (251) of the lock post (25) is parallel with the latch bolt (21), the latch bolt (21) can be removed from the central hole (222) and the cable lock can be unlocked. In addition, because the rotation of the lock post (25) is activated by the plate (26), and the plate (26) activated by the block (232) of the spindle (231) will move in the same direction without regard to whether the spindle (231) is rotated clockwise or counterclockwise. Therefore, the user can turn the key right or left to unlock the cable lock. This can increase the utility of the cable lock.

Even though numerous characteristics and advantages of the present invention have been set forth in the foregoing description, together with details of the structure and functions of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable lock comprising:

a cable having a first end and a second end;

a latch assembly having a body provided with a first end that is connected to said first end of said cable;

a latch bolt detachably inserted into a second end of said body and connected to said second end of said cable;

a lock post rotatably mounted in said body for said latch bolt to be securely locked in said body;

a cylinder securely mounted in said body and having a spindle rotatably mounted on one end of said cylinder;

means for activating said lock post to rotate with said spindle to release said latch bolt;

a twisting spring coaxially mounted on said lock post to provide a twisting force to said post; and two protrusions formed on one end of said lock post to hold one end of said twisting spring therebetween.

2. The cable lock as claimed in claim 1, wherein a connecting tube extends from said first end of said body to connect with said first end of said cable.

3. The cable lock as claimed in claim 1, wherein a head is formed on a first end of said latch bolt;

a neck with a diameter smaller than that of said latch bolt is formed between said latch bolt and said head; and a recess is defined in an outer periphery of said lock post so as to form a locking portion to abut said neck to securely position said latch bolt in said body.

4. The cable lock as claimed in claim 3, wherein a connecting tube extends from a second end of said latch bolt to connect with said second end of said cable.

5. The cable lock as claimed in claim 3, wherein a central hole is defined in said second end of said body for said latch bolt to be inserted; and a hole is defined in said body and communicating with said central hole to receive said lock post therein.

6. The cable lock as claimed in claim 5, wherein the twisting spring is mounted in said hole.

7. The cable lock as claimed in claim 6, wherein two protrusions arc formed on a bottom of said hole defined therein to hold the other one end of said spring therebetween.

8. The cable lock as claimed in claim 1, wherein a chamber is defined in said body to receive said cylinder therein.

9. The cable lock as claimed in claim 1, wherein a recess is defined in an outer periphery of said body;

a cover mounted on said body to cover said recess; and said activating means comprises a semicircular block protruding from said spindle and extending into said recess;

a semicircular block protruding from said lock post and extending into said recess; and a plate slidably mounted in said recess of said body between said blocks.

10. The cable lock as claimed in claim 9, wherein a track is defined in a face defining said recess to slidably receive said plate therein.

11. The cable lock as claimed in claim 1, wherein a lock unit is mounted in said cylinder; and a keyhole is defined in the other end of said cylinder.

12. The cable lock as claimed in claim 1 further comprising a hole defined in said body to receive said lock post therein; and two protrusions formed on a bottom of said hole to hold the other end of said twisting spring therebetween.

* * * * *